US010309227B2

(12) United States Patent
Weber et al.

(10) Patent No.: US 10,309,227 B2
(45) Date of Patent: Jun. 4, 2019

(54) MULTI-TURN COOLING CIRCUITS FOR TURBINE BLADES

(71) Applicant: General Electric Company, Schenectady, NY (US)

(72) Inventors: David Wayne Weber, Simpsonville, SC (US); Sandip Dutta, Greenville, SC (US)

(73) Assignee: General Electric Company, Schenectady, NY (US)

( * ) Notice: Subject to any disclaimer, the term of this patent is extended or adjusted under 35 U.S.C. 154(b) by 331 days.

(21) Appl. No.: 15/334,563

(22) Filed: Oct. 26, 2016

(65) Prior Publication Data

US 2018/0112537 A1 Apr. 26, 2018

(51) Int. Cl.
*F01D 5/18* (2006.01)
*F01D 9/02* (2006.01)

(52) U.S. Cl.
CPC ..... *F01D 5/187* (2013.01); *F01D 9/026* (2013.01); *F01D 5/186* (2013.01); *F05D 2220/32* (2013.01); *F05D 2240/304* (2013.01); *F05D 2260/202* (2013.01)

(58) Field of Classification Search
CPC ..... F01D 5/186; F01D 5/187; F01D 9/026; F05D 2220/32; F05D 2240/304; F05D 2260/202; F05D 2250/185
See application file for complete search history.

(56) References Cited

U.S. PATENT DOCUMENTS 2,744,723 A 5/1956 Roush
3,220,697 A 11/1965 Smuland et al.
3,844,679 A 10/1974 Grondahl et al.
3,849,025 A 11/1974 Grondahl
4,021,139 A 5/1977 Franklin
4,302,153 A 11/1981 Tubbs
4,684,322 A * 8/1987 Clifford ..... F01D 5/187 415/175

(Continued)

FOREIGN PATENT DOCUMENTS

EP 1 001 137 A2 5/2000
GB 2 163 219 A 2/1986

OTHER PUBLICATIONS

U.S. Appl. No. 15/334,483, Office Action dated Jun. 28, 2018, 13 pages.

(Continued)

*Primary Examiner* — Dwayne J White
*Assistant Examiner* — Wesley Le Fisher
(74) *Attorney, Agent, or Firm* — Ernest G. Cusick; Hoffman Warnick LLC

(57) ABSTRACT

A trailing edge cooling system for a turbine blade is disclosed. The system may include a cooling circuit including an outward leg, and a return leg positioned adjacent the outward leg. The outward and return leg each may extend toward and away, respectively, from a trailing edge of the turbine blade. The cooling circuit may also include a plurality of turn legs. The plurality of turn legs may include a turn leg positioned directly adjacent the trailing edge of the turbine blade, and a distinct turn leg positioned axially adjacent the turn leg, and opposite the trailing edge of the turbine blade. The distinct turn leg may be oriented non-parallel to at least one of the outward leg and the return leg.

17 Claims, 9 Drawing Sheets

(56) References Cited

U.S. PATENT DOCUMENTS 4,761,116 A 8/1988 Braddy et al.
4,940,388 A 7/1990 Lilleker et al.
5,100,293 A 3/1992 Anzai et al.
5,464,322 A 11/1995 Cunha et al.
5,536,143 A 7/1996 Jacala et al.
5,915,923 A 6/1999 Tomita et al.
5,967,752 A * 10/1999 Lee ..... F01D 5/187 416/97 R
5,997,251 A * 12/1999 Lee ..... F01D 5/187 416/97 R
6,099,252 A 8/2000 Manning et al.
6,227,804 B1 5/2001 Koga et al.
6,247,896 B1 6/2001 Auxier et al.
6,499,949 B2 12/2002 Schafrik et al.
6,547,522 B2 4/2003 Turnquist et al.
6,547,525 B2 4/2003 Haehnle et al.
7,435,053 B2 10/2008 Liang
7,530,789 B1 5/2009 Liang
7,670,113 B1 * 3/2010 Liang ..... F01D 5/081 416/96 R
7,717,675 B1 5/2010 Liang
7,785,070 B2 8/2010 Liang
7,845,906 B2 12/2010 Spangler et al.
7,985,049 B1 7/2011 Liang
8,047,788 B1 * 11/2011 Liang ..... F01D 5/187 416/97 R
8,317,472 B1 * 11/2012 Liang ..... F01D 5/187 416/92
8,322,988 B1 12/2012 Downs et al.
8,398,370 B1 3/2013 Liang
8,562,295 B1 10/2013 Liang
8,608,430 B1 12/2013 Liang
8,628,298 B1 * 1/2014 Liang ..... F01D 5/187 416/96 R
8,678,766 B1 3/2014 Liang
8,790,083 B1 * 7/2014 Liang ..... F01D 5/186 416/97 R
8,864,469 B1 * 10/2014 Liang ..... F01D 5/187 416/97 R
9,447,692 B1 9/2016 Liang
9,970,302 B2 5/2018 Lacy et al.
2005/0058534 A1 3/2005 Lee et al.
2009/0193657 A1 8/2009 Wilson, Jr. et al.
2010/0303625 A1 12/2010 Kuhne et al.
2013/0108471 A1 * 5/2013 Fujimoto ..... F01D 5/186 416/97 R
2013/0272850 A1 10/2013 Bunker
2014/0093379 A1 4/2014 Tibbott et al.
2014/0127013 A1 5/2014 Spangler et al.
2014/0161626 A1 6/2014 Podgorski et al.
2015/0041590 A1 2/2015 Kirtley et al.
2015/0044059 A1 2/2015 Wassynger et al.
2015/0096305 A1 4/2015 Morgan et al.
2015/0147164 A1 5/2015 Cui et al.
2015/0252728 A1 * 9/2015 Veiga ..... F01D 25/28 60/796
2015/0345303 A1 12/2015 Dong et al.
2016/0169003 A1 6/2016 Wong et al.
2016/0177741 A1 6/2016 Kirollos et al.
2017/0234154 A1 8/2017 Downs
2017/0350259 A1 * 12/2017 Dutta ..... B33Y 10/00
2018/0112533 A1 4/2018 Weber
2018/0112534 A1 4/2018 Snider et al.
2018/0112535 A1 4/2018 Weber et al.
2018/0112536 A1 4/2018 Weber et al.
2018/0112538 A1 4/2018 Weber et al.
2018/0112539 A1 4/2018 Weber et al.
2018/0112540 A1 4/2018 Hoskin et al.
2018/0112541 A1 4/2018 Weber et al.
2018/0112547 A1 4/2018 Snider et al.
2018/0230815 A1 * 8/2018 Jones ..... F01D 5/187

OTHER PUBLICATIONS

U.S. Appl. No. 15/334,585, Office Action dated Jul. 31, 2018, 22 pages.
U.S. Appl. No. 15/334,517, Office Action dated Aug. 6, 2018, 24 pages.
U.S. Appl. No. 15/334,501, Office Action dated Aug. 10, 2018, 17 pages.
U.S. Appl. No. 15/334,450, Office Action dated Aug. 15, 2018, 49 pages.
Extended European Search Report and Opinion issued in connection with corresponding EP Application No. 17197845.5 dated Mar. 13, 2018.
U.S. Appl. No. 15/334,474, Office Action dated Dec. 31, 2018, 13 pages.
U.S. Appl. No. 15/334,450, Notice of Allowance dated Jan. 10, 2019, 12 pages.
U.S. Appl. No. 15/334,501, Notice of Allowance dated Jan. 17, 2019, 11 pages.
U.S. Appl. No. 15/334,454, Notice of Allowance dated Jan. 24, 2019, 23 pages.
U.S. Appl. No. 15/334,585, Final Office Action dated Feb. 8, 2019, 20 pages.
U.S. Appl. No. 15/334,517, Notice of Allowance dated Mar. 20, 2019, 9 pgs.

* cited by examiner

MULTI-TURN COOLING CIRCUITS FOR TURBINE BLADES

CROSS-REFERENCE TO RELATED APPLICATION

This application is related to co-pending U.S. application Ser. Nos. 15/334,474, 15/334,454, 15/334,585, 15/334,448, 15/334,501, 15/334,517, 15/334,450, 15/334,471, and 15/334,483, all filed on Oct. 26, 2016.

TECHNICAL FIELD

The disclosure relates generally to turbine systems, and more particularly, to multi-turn cooling circuits for turbine blades of a turbine system.

BACKGROUND

Gas turbine systems are one example of turbomachines widely utilized in fields such as power generation. A conventional gas turbine system includes a compressor section, a combustor section, and a turbine section. During operation of a gas turbine system, various components in the system, such as turbine blades and nozzle airfoils, are subjected to high temperature flows, which can cause the components to fail. Since higher temperature flows generally result in increased performance, efficiency, and power output of a gas turbine system, it is advantageous to cool the components that are subjected to high temperature flows to allow the gas turbine system to operate at increased temperatures.

A multi-wall airfoil for a turbine blade typically contains an intricate maze of internal cooling passages. Cooling air (or other suitable coolant) provided by, for example, a compressor of a gas turbine system, may be passed through and out of the cooling passages to cool various portions of the multi-wall airfoil and/or turbine blade. Cooling circuits formed by one or more cooling passages in a multi-wall airfoil may include, for example, internal near wall cooling circuits, internal central cooling circuits, tip cooling circuits, and cooling circuits adjacent the leading and trailing edges of the multi-wall airfoil.

SUMMARY

A first embodiment may include a trailing edge cooling system for a turbine blade. The trailing edge cooling system includes: a cooling circuit including: an outward leg extending axially toward a trailing edge of the turbine blade; a return leg positioned adjacent the outward leg and extending axially from the trailing edge of the turbine blade; and a plurality of turn legs fluidly coupling the outward leg and the return leg, the plurality of turn legs including: a turn leg positioned directly adjacent the trailing edge of the turbine blade; and a distinct turn leg positioned axially adjacent the turn leg, opposite the trailing edge of the turbine blade, the distinct turn leg oriented non-parallel to at least one of the outward leg and the return leg.

Another embodiment may include a turbine blade including: a trailing edge cooling system disposed within the turbine blade, the trailing edge cooling system including: a plurality of cooling circuits extending at least partially along a radial length of a trailing edge of the turbine blade, at least one of the cooling circuits including: an outward leg extending axially toward the trailing edge of the turbine blade; a return leg positioned adjacent the outward leg and extending axially from the trailing edge of the turbine blade; and a plurality of turn legs fluidly coupling the outward leg and the return leg, the plurality of turn legs including: a turn leg positioned directly adjacent the trailing edge of the turbine blade; and a distinct turn leg positioned axially adjacent the turn leg, opposite the trailing edge of the turbine blade, the distinct turn leg oriented non-parallel to at least one of the outward leg and the return leg.

A further embodiment may include a turbomachine, including: a turbine component including a plurality of turbine blades; and a trailing edge cooling system disposed within at least one of the plurality of turbine blades, the trailing edge cooling system including: a plurality of cooling circuits extending at least partially along a radial length of a trailing edge of the turbine blade, at least one of the plurality of cooling circuit including: an outward leg extending axially toward the trailing edge of the turbine blade; a return leg positioned adjacent the outward leg and extending axially from the trailing edge of the turbine blade; and a plurality of turn legs fluidly coupling the outward leg and the return leg, the plurality of turn legs including: a turn leg positioned directly adjacent the trailing edge of the turbine blade; and a distinct turn leg positioned axially adjacent the turn leg, opposite the trailing edge of the turbine blade, the distinct turn leg oriented non-parallel to at least one of the outward leg and the return leg.

The illustrative aspects of the present disclosure solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure.

Figure 1:
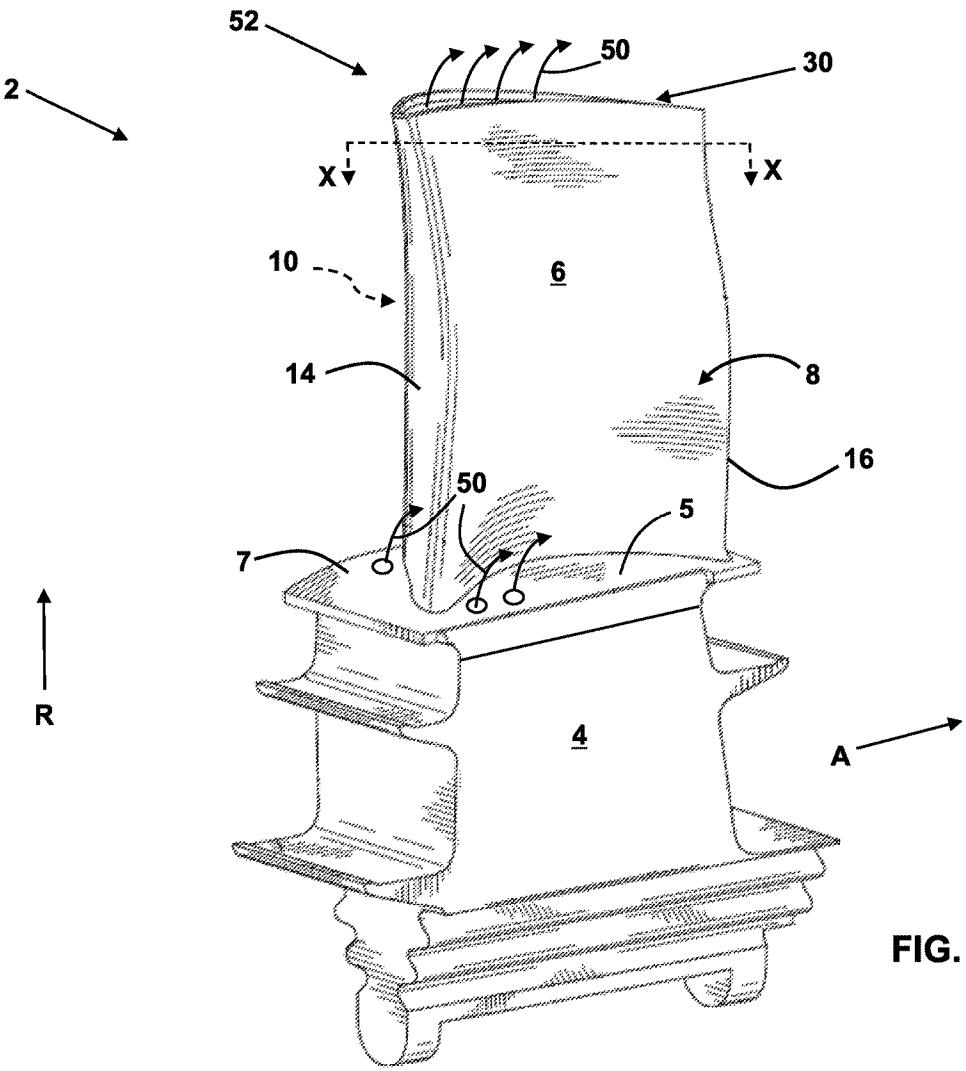
FIG. 1 is a perspective view of a turbine blade having a multi-wall airfoil according to various embodiments.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

As indicated above, the disclosure relates generally to turbine systems, and more particularly, to multi-turn cooling circuits for turbine blades of a turbine system. As used herein, an airfoil of a turbine blade may include, for example, a multi-wall airfoil for a rotating turbine blade or a nozzle or airfoil for a stationary vane utilized by turbine systems.

According to embodiments, a trailing edge cooling circuit with flow reuse is provided for cooling a turbine blade, and specifically a multi-wall airfoil, of a turbine system (e.g., a gas turbine system). A flow of coolant is reused after flowing through the trailing edge cooling circuit. After passing through the trailing edge cooling circuit, the flow of coolant may be collected and used to cool other sections of the airfoil and/or turbine blade. For example, the flow of coolant may be directed to at least one of the pressure or suction sides of the multi-wall airfoil of the turbine blade for convection and/or film cooling. Further, the flow of coolant may be provided to other cooling circuits within the turbine blade, including tip, and platform cooling circuits.

Traditional trailing edge cooling circuits typically eject the flow of coolant out of a turbine blade after it flows through a trailing edge cooling circuit. This is not an efficient use of the coolant, since the coolant may not have been used to its maximum heat capacity before being exhausted from the turbine blade. Contrastingly, according to embodiments, a flow of coolant, after passing through a trailing edge cooling circuit, is used for further cooling of the multi-wall airfoil and/or turbine blade.

In the Figures (see, e.g., FIG. 11), the "A" axis represents an axial orientation. As used herein, the terms "axial" and/or "axially" refer to the relative position/direction of objects along axis A, which is substantially parallel with the axis of rotation of the turbine system (in particular, the rotor section). As further used herein, the terms "radial" and/or "radially" refer to the relative position/direction of objects along an axis "R" (see, e.g., FIG. 1), which is substantially perpendicular with axis A and intersects axis A at only one location. Finally, the term "circumferential" refers to movement or position around axis A (e.g., axis "C").

Turning to FIG. 1, a perspective view of a turbine blade 2 is shown. Turbine blade 2 includes a shank 4 and a multi-wall airfoil 6 coupled to and extending radially outward from shank 4. Multi-wall airfoil 6 includes a pressure side 8, an opposed suction side 10, and a tip area 52. Multi-wall airfoil 6 further includes a leading edge 14 between pressure side 8 and suction side 10, as well as a trailing edge 16 between pressure side 8 and suction side 10 on a side opposing leading edge 14. Multi-wall airfoil 6 extends radially away from a pressure side platform 5 and a suction side platform 7.

shank 4 and multi-wall airfoil 6 of turbine blade 2 may each be formed of one or more metals (e.g., nickel, alloys of nickel, etc.) and may be formed (e.g., cast, forged or otherwise machined) according to conventional approaches. Shank 4 and multi-wall airfoil 6 may be integrally formed (e.g., cast, forged, three-dimensionally printed, etc.), or may be formed as separate components which are subsequently joined (e.g., via welding, brazing, bonding or other coupling mechanism).

Figure 2:
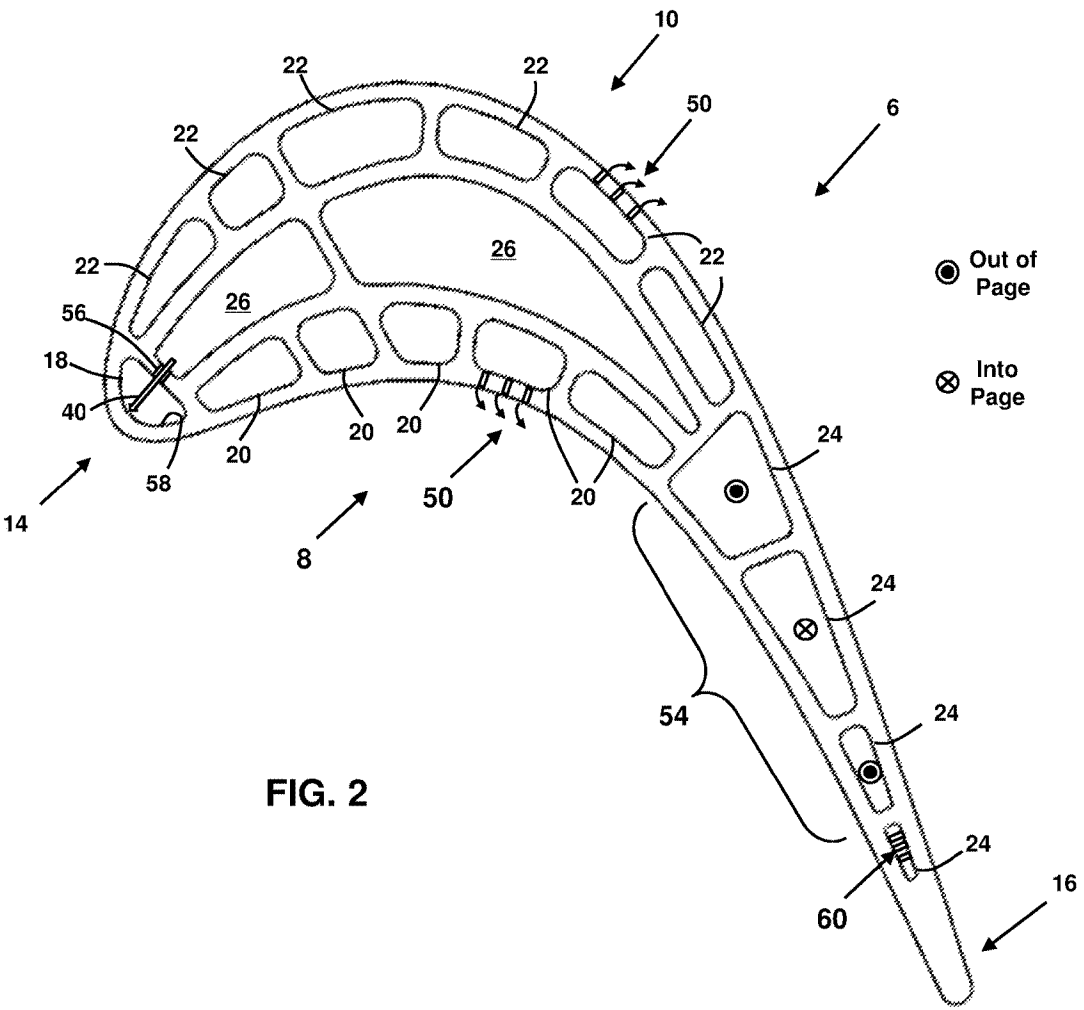
FIG. 2 is a cross-sectional view of the turbine blade of FIG. 1, taken along line X-X in FIG. 1 according to various embodiments.

FIG. 2 depicts a cross-sectional view of multi-wall airfoil 6 taken along line X-X of FIG. 1. As shown, multi-wall airfoil 6 may include a plurality of internal passages. In embodiments, multi-wall airfoil 6 includes at least one leading edge passage 18, at least one pressure side (near wall) passage 20, at least one suction side (near wall) passage 22, at least one trailing edge passage 24, and at least one central passage 26. The number of passages 18, 20, 22, 24, 26 within multi-wall airfoil 6 may vary, of course, depending upon for example, the specific configuration, size, intended use, etc., of multi-wall airfoil 6. To this extent, the number of passages 18, 20, 22, 24, 26 shown in the embodiments disclosed herein is not meant to be limiting. According to embodiments, various cooling circuits can be provided using different combinations of passages 18, 20, 22, 24, 26.

Figure 4:
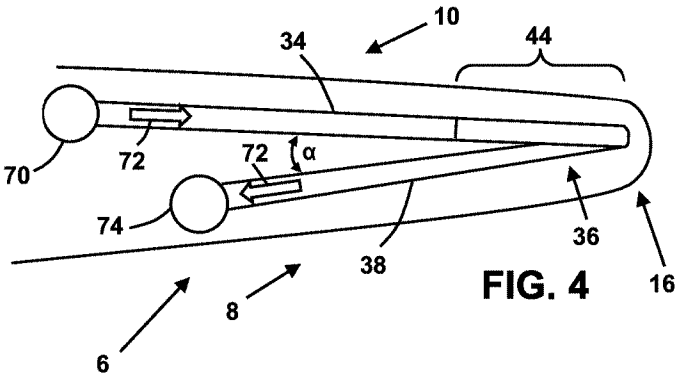
FIG. 4 is a top cross-sectional view of the cooling circuit of FIG. 3 according to various embodiments.
Figure 5:
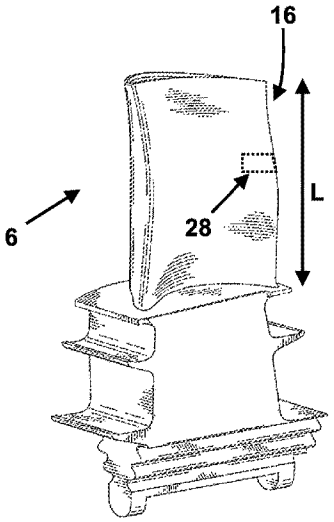
FIG. 5 depicts the section shown in FIGS. 3 and 4 of the turbine blade of FIG. 1 according to various embodiments.
Figure 3:
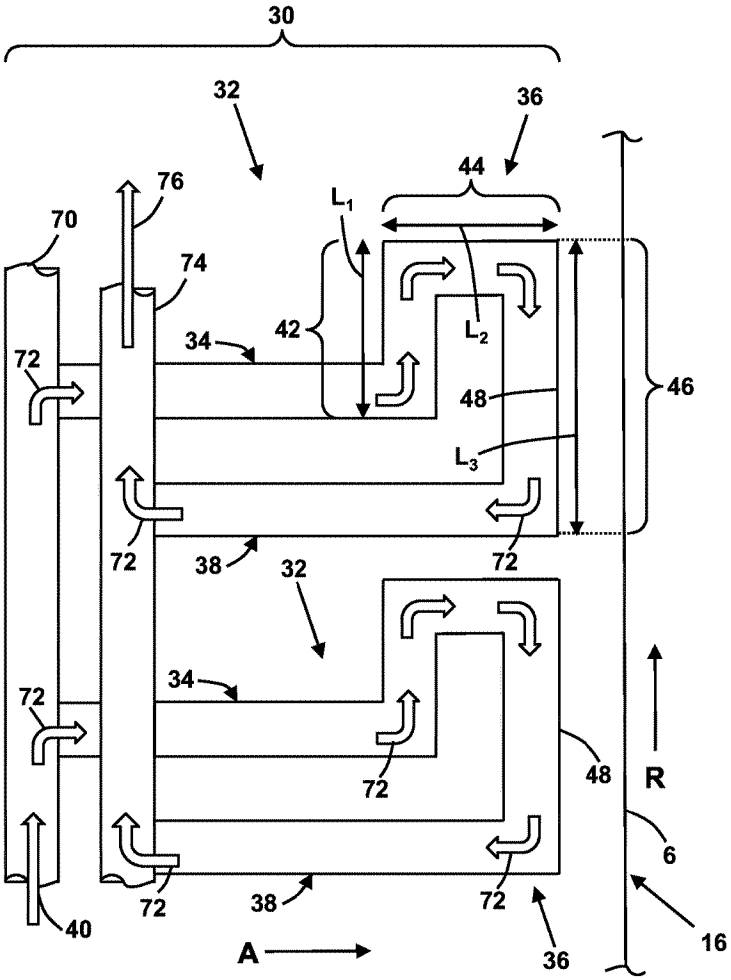
FIG. 3 is a side view of cooling circuits including a plurality of turn legs of a trailing edge cooling system according to various embodiments.

An embodiment including a trailing edge cooling system 30 is depicted in FIGS. 3-5. As the name indicates, trailing edge cooling system 30 is located adjacent trailing edge 16 of multi-wall airfoil 6, between pressure side 8 and suction side 10 of multi-wall airfoil 6.

Trailing edge cooling system 30 includes a plurality of radially spaced (i.e., along the "R" axis (see, e.g., FIG. 1)) cooling circuits 32 (only two are shown), each including an outward leg 34, a plurality of turn legs 36, and a return leg 38. Outward leg 34 extends axially toward and/or substantially perpendicular to trailing edge 16 of multi-wall airfoil 6. Return leg 38 extends axially toward leading edge 14 of multi-wall airfoil 6. Additionally as shown in FIG. 3, return leg 38 extends axially away from and/or substantially perpendicular to trailing edge 16 of multi-wall airfoil 6. As such, outward leg 34 and return leg 38 may be, for example, positioned and/or oriented substantially in parallel with respect to one another. Return leg 38 for each cooling circuit 32 forming trailing edge cooling system 30 may be positioned below and/or closer to shank 4 of turbine blade 2 than the corresponding outward leg 34 in fluid communication with return leg 38. In embodiments, trailing edge cooling system 30, and/or the plurality of cooling circuits 32 forming trailing edge cooling system 30, may extend along the entire radial length (L) (FIG. 5) of trailing edge 16 of multi-wall airfoil 6. In other embodiments, trailing edge cooling system 30 may partially extend along one or more portions of trailing edge 16 of multi-wall airfoil 6.

In each cooling circuit 32, outward leg 34 is radially offset along the "R" axis relative to return leg 38 by the plurality of turn legs 36. To this extent, the plurality of turn legs 36 fluidly couples outward leg 34 of cooling circuit 32 to return leg 38 of cooling circuit 32, as discussed herein. In the non-limiting embodiment shown in FIG. 3, for example, outward leg 34 is positioned radially outward relative to return leg 36 in each of cooling circuits 32. In other embodiments, in one or more of cooling circuits 32, the radial positioning of outward leg 34 relative to return leg 38 may be reversed such that outward leg 34 is positioned radially inward relative to return leg 38. A non-limiting position 28 of the portion of trailing edge cooling system 30 depicted in FIG. 3 within multi-wall airfoil 6 is illustrated in FIG. 5.

As shown in FIG. 4, in addition to a radial offset, outward leg 34 may be circumferentially offset by the plurality of turn legs 36 at an angle $\alpha$ relative to return leg 38. In this configuration, outward leg 34 extends along suction side 10 of multi-wall airfoil 6, while return leg 38 extends along pressure side 8 of multi-wall airfoil 6. The radial and circumferential offsets may vary, for example, based on geometric and heat capacity constraints on trailing edge cooling system 30 and/or other factors. In other embodiments, outward leg 34 may extend along pressure side 8 of multi-wall airfoil 6, while return leg 38 may extend along suction side 10 of multi-wall airfoil 6.

As shown in FIG. 3, the plurality of turn legs 36 may include various turn legs for (fluidly) coupling, joining and/or providing outward leg 34 to be in fluid communication with return leg 38. Specifically, outward leg 34 may be in fluid communication with return leg 38 via the plurality of turn legs 36 of cooling circuit 32, such that a coolant 40 may pass from and/or flow through outward leg 34, through the plurality of turn legs 36, and to return leg 38, as discussed herein. As shown in FIG. 3, the plurality of turn legs 36 of cooling circuit 32 may be positioned adjacent to trailing edge 16 of multi-wall airfoil 6. Specifically, one turn leg of the plurality of turn legs 36 may be positioned directly adjacent, extend radially adjacent to and/or may be substantially parallel to trailing edge 16 of multi-wall airfoil 6. As discussed in detail below, the plurality of turn legs 36 of cooling circuit 32, and specifically the turn leg of the plurality of turn legs 36 that may be positioned directly adjacent to and/or radially extend substantially parallel to trailing edge 16, may provide the greatest amount of heat transfer to cool trailing edge 16 of multi-wall airfoil 6.

In a non-limiting example shown in FIG. 3, the plurality of turn legs 36 may include a first turn leg 42, a second turn leg 44 and a third turn leg 46. First turn leg 42 of the plurality of turn legs 36 may be positioned between outward leg 34 and return leg 38, and more specifically, may be in direct fluid communication with and/or fluidly coupled with outward leg 34 and return leg 38. First turn leg 42 may form a first turn, curve, bend and/or change in flow direction for coolant 40 within cooling circuit 32. First turn leg 42 may be oriented and/or formed to be non-parallel with outward leg 34 and/or return leg 38. In a non-limiting example shown in FIG. 3, first turn leg 42 may extend substantially perpendicular from outward leg 34. Specifically, first turn leg 42 of the plurality of turn legs 36 may extend radially upward, away from and/or above outward leg 34, such that first turn leg 42 is positioned and/or oriented substantially perpendicular to outward leg 34. First turn leg 42 may radially extend above and/or away from outward leg 34 toward tip area 52 of multi-wall airfoil 6 (see, e.g., FIG. 1). As shown in the non-limiting example of FIG. 3, first turn leg 42 may also radially extend substantially parallel to trailing edge 16 of multi-wall airfoil 6. As a result of return leg 38 being positioned below and substantially parallel to outward leg 34, it is understood that first turn leg 42 may also be positioned substantially perpendicular to and/or may radially extend away from and/or above return leg 38.

Second turn leg 44 of the plurality of turn legs 36 may be in direct fluid communication with and/or fluidly coupled with first turn leg 42. Additionally, and as discussed herein, second turn leg 44 may be in direct fluid communication with and/or fluidly coupled with third turn leg 46, and may be positioned between first turn leg 42 and third turn leg 46 of the plurality of turn legs 36. Second turn leg 44 may form a second turn, curve, bend and/or change in flow direction for coolant 40 within cooling circuit 32 from first turn leg 42. Second turn leg 44 of the plurality of turn legs 36 may extend substantially perpendicular from first turn leg 42. Specifically in the non-limiting example shown in FIG. 3, second turn leg 44 may extend axially away from and/or may extend axially toward trailing edge 16 of multi-wall airfoil 6, such that second turn leg 44 is substantially perpendicular to first turn leg 42. As a result, second turn leg 44 may also extend substantially perpendicular to trailing edge 16 of multi-wall airfoil 6, and may be substantially parallel to outward leg 34 and/or return leg 38. As shown in FIG. 3, second turn leg 44 of cooling circuit 32 may be positioned radially above and/or closer to tip area 52 than the corresponding outward leg 34 and/or return leg 38 of cooling circuit 32.

As shown in FIG. 3, third turn leg 46 of the plurality of turn legs 36 may be in direct fluid communication with and may be positioned between second turn leg 44 and return leg 38. That is, third turn leg 46 may be positioned between second turn leg 44 and return leg 38 to fluidly couple the plurality of turn legs 36, and specifically second turn leg 44, to return leg 38 of cooling circuit 32. Similar to first turn leg 42 and second turn leg 44, third turn leg 46 may form a third turn, curve, bend and/or change in flow direction for coolant 40 within cooling circuit 32. Also similar to first turn leg 42, third turn leg 46 may be oriented and/or formed to be non-parallel with outward leg 34 and/or return leg 38. In a non-limiting example shown in FIG. 3, third turn leg 46 of the plurality of turn legs 36 may extend substantially perpendicular to return leg 38. Specifically, third turn leg 46 may extend radially downward, away from and/or substantially below second turn leg 44 toward return leg 38 and/or shank 4 of turbine blade 2 (see, e.g., FIG. 1). Third turn leg 46 may also radially extend substantially parallel to first turn leg 42 and, may extend radially adjacent to and/or substantially parallel to trailing edge 16 of multi-wall airfoil 6. Additionally, third turn leg 46 of the plurality of turn legs 36 may be positioned directly adjacent trailing edge 16 of multi-wall airfoil 6, such that no other component, cooling circuit 32 or the like is positioned between third turn leg 46 and trailing edge 16. In the non-limiting example shown in FIG. 3, at least a portion of third turn leg 46 may be positioned and/or radially extend above outward leg 34 and/or return leg 38. The portion of third turn leg 46 that may be positioned and/or radially extend above outward leg 34 and/or return leg 38 may be a portion of third turn leg 46 positioned directly adjacent second turn leg 44 and/or axially aligned with first turn leg 42. Because outward leg 34 is substantially parallel to return leg 38, it is understood that third turn leg 46 may also be positioned substantially perpendicular to outward leg 34.

Third turn leg 46 may include a length ($L_3$) substantially longer than the remaining turn legs (e.g., first turn leg 42, second turn leg 44) of the plurality of turn legs 36 of cooling circuit 32. Specifically, third turn leg 46 may include an outer wall 48 which includes a length ($L_3$) that may be greater than the length ($L_1$) of first turn leg 42 and/or the length ($L_2$) of second turn leg 44. As shown in FIG. 3, outer wall 48 of third turn leg 46 may be substantially parallel to and may be positioned directly adjacent to trailing edge 16 of multi-wall airfoil 6. As such, outer wall 48 of third turn leg 46 may be the closest portion and/or component of cooling circuit 32 to trailing edge 16 of multi-wall airfoil 6. As discussed herein, the orientation and/or positioning of each of the turn legs of the plurality of turn legs 36, as well as the length of outer wall 48 of third turn leg 46, may improve the heat transfer within cooling circuit 32.

A flow of coolant 40, for example, air generated by a compressor 104 of a gas turbine system 102 (FIG. 11), flows into trailing edge cooling system 30 via at least one coolant feed 70. Each coolant feed 70 may be formed, for example, using one of trailing edge passages 24 depicted in FIG. 2 or may be provided using any other suitable source or supply plenum of coolant in multi-wall airfoil 6. At each cooling circuit 32, a portion 72 of the flow of coolant 40 passes into outward leg 34 of cooling circuit 32 and flows towards the plurality of turn legs 36. Portion 72 of coolant 40 is redirected and/or moved in various directions as the coolant flows through the plurality of turn legs 36 of cooling circuit 32, as discussed herein. Portion 72 of coolant 40 subsequently flows into return leg 38 of cooling circuit 32 from the plurality of turn legs 36. Portion 72 of the flow of coolant 40 passing into each outward leg 34 may be the same for each cooling circuit 32. Alternatively, portion 72 of the flow of coolant 40 passing into each outward leg 34 may be different for different sets (i.e., one or more) of cooling circuits 32.

portion 72 of the flow of coolant 40 flowing through cooling circuit 32 may flow through outward leg 34 to the plurality of turn legs 36 and may subsequently be redirected and/or moved in various directions through the plurality of turn legs 36. In a non-limiting example shown in FIG. 3, portion 72 of coolant 40 flows through outward leg 34 to first turn leg 42 of the plurality of turn legs 36 and may be redirected radially upward and/or perpendicularly away from outward leg 34 as the coolant flows through first turn leg 42. Portion 72 of coolant 40 may then flow from first turn leg 42 to second turn leg 44 of the plurality of turn legs 36 of cooling circuit 32. More specifically, portion 72 of coolant 40 may be axially redirected toward trailing edge 16 of multi-wall airfoil 6 and/or may flow perpendicularly from first turn leg 42 as the coolant flows through second turn leg 44. Portion 72 of coolant 40 may subsequently flow from second turn leg 44 to third turn leg 46, and ultimately to return leg 38. In the non-limiting example shown in FIG. 3, portion 72 of coolant 40 may be radially redirected toward return leg 38 and/or may flow perpendicularly from second turn leg 44 as the coolant flows through third turn leg 46. Additionally, portion 72 of coolant 40 flowing through third turn leg 46 may flow substantially parallel to trailing edge 16 of multi-wall airfoil 6 and may flow over outer wall 48 of third turn leg 46. Once portion 72 of coolant 40 flows through third turn leg 46, it is redirected and/or moved into return leg 38. That is, portion 72 of coolant 40 is axially redirected into return leg 38 from third turn leg 46 and/or redirected to flow substantially perpendicular to and/or axially away from trailing edge 16 of multi-wall airfoil 6.

The orientation and/or positioning of each of the turn legs of the plurality of turn legs 36 may improve the heat transfer within cooling circuit 32. That is, the orientation of each of the plurality of turn legs 36, the position or orientation (e.g., adjacent, parallel) of one turn leg (e.g., third turn leg 46) of the plurality of turn legs 36 with respect to trailing edge 16 and/or the flow path in which coolant 40 flows through the plurality of turn legs 36 may improve heat transfer and/or the cooling of trailing edge 16 of multi-wall airfoil 6 of turbine blade 2. In the non-limiting example shown in FIG. 3, a portion of the plurality of turn legs 36 (e.g., first turn leg 42, second turn leg 44) are positioned and/or oriented within cooling circuit 32 to allow for third turn leg 46 to be positioned directly adjacent to and extend radially adjacent or substantially parallel to trailing edge 16. As a result of the position and/or orientation of third turn leg 46 with respect to trailing edge 16, the greatest amount of heat transfer may occur between third turn leg 46 and trailing edge 16 to adequately cool trailing edge 16 of multi-wall airfoil 6.

According to embodiments, portion 72 of coolant 40 in the plurality of cooling circuits 32 of trailing edge cooling system 30 flow out of return legs 38 of cooling circuits 32 into a plenum or collection passage 74. A single plenum or collection passage 74 may be provided, however multiple plenums or collection passages 74 may also be utilized. Collection passage 74 may be formed, for example, using one of trailing edge passages 24 depicted in FIG. 2 or may be provided using one or more other passages and/or passages within multi-wall airfoil 6. Although shown as flowing radially outward through collection passage 74 in FIG. 3, the "used" coolant may instead flow radially inward through collection passage 74.

Collection coolant 76, or a portion thereof, flowing into and through collection passage 74 may be directed (e.g. using one or more passages (e.g., passages 18-24) and/or passages within multi-wall airfoil 6) to one or more additional cooling circuits of multi-wall airfoil 6. To this extent, at least some of the remaining heat capacity of collection coolant 76 is exploited for cooling purposes instead of being inefficiently expelled from trailing edge 16 of multi-wall airfoil 6.

Collection coolant 76, or a portion thereof, may be used to provide film cooling to various areas of multi-wall airfoil 6. For example, as depicted in FIGS. 1 and 2, collection coolant 76 may be used to provide cooling film 50 to one or more of pressure side 8, suction side 10, pressure side platform 5, suction side platform 7, and tip area 52 of multi-wall airfoil 6.

Collection coolant 76, or a portion thereof, may also be used in a multi-passage (e.g., serpentine) cooling circuit in multi-wall airfoil 6. For example, collection coolant 76 may be fed into a serpentine cooling circuit formed by a plurality of pressure side passages 20, a plurality of suction side passages 22, a plurality of trailing edge passages 24, or combinations thereof. An illustrative serpentine cooling circuit 54 formed using a plurality of trailing edge passages 24 is depicted in FIG. 2. In serpentine cooling circuit 54, at least a portion of collection coolant 76 flows in a first radial direction (e.g., out of the page) through a trailing edge passage 24, in an opposite radial direction (e.g., into the page) through another trailing edge passage 24, and in the first radial direction through yet another trailing edge passage 24. Similar serpentine cooling circuits 54 may be formed using pressure side passages 20, suction side passages 22, central passages 26, or combinations thereof.

Collection coolant 76 may also be used for impingement cooling, or together with pin fins. For example, in the non-limiting example depicted in FIG. 2, at least a portion of collection coolant 76 may be directed to a central passage 26, through an impingement hole 56, and onto a forward surface 58 of a leading edge passage 18 to provide impingement cooling of leading edge 14 of multi-wall airfoil 6. Other uses of coolant 40 for impingement are also envisioned. At least a portion of collection coolant 76 may also be directed through a set of cooling pin fins 60 (e.g., within a passage (e.g., a trailing edge passage 24)). Many other cooling applications employing collection coolant 76 are also possible.

Figure 6:
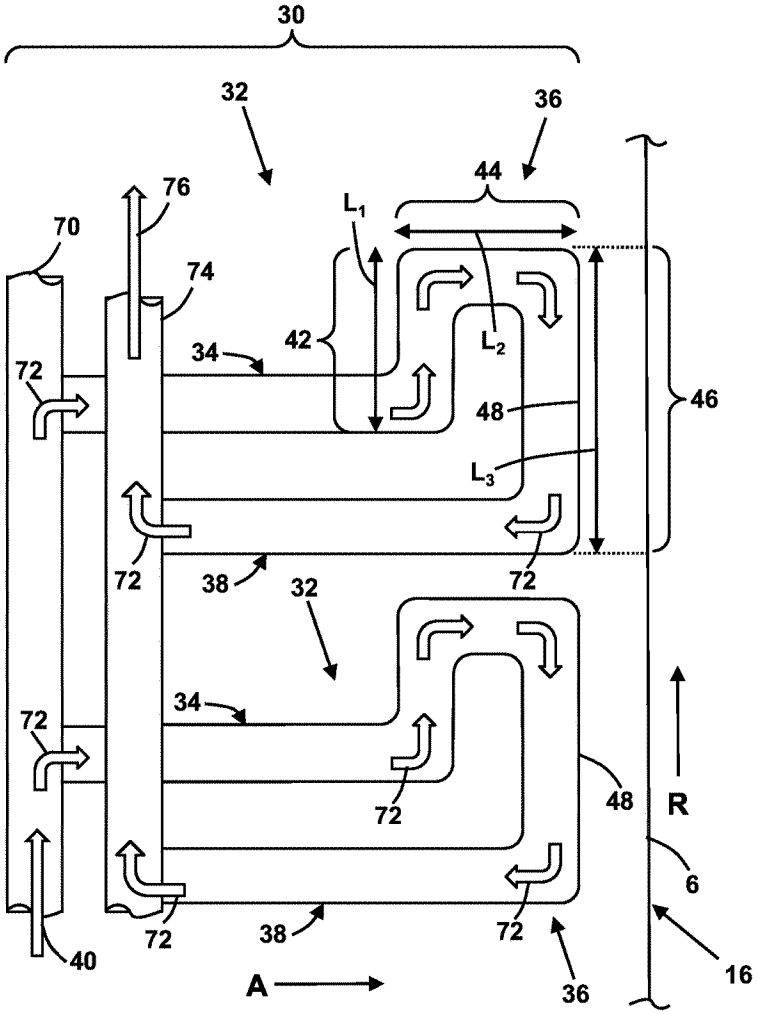
FIG. 6 is a side view of cooling circuits including a plurality of turn legs of a trailing edge cooling system according to additional embodiments.

FIG. 6 depicts another non-limiting example of a trailing edge cooling system 30 including a cooling circuit 32 having a plurality of turn legs 36. With comparison to FIG. 3, the non-limiting example of cooling circuit 32 shown in FIG. 6 may include smooth, curved and/or less severe transitions (e.g., 90° turns) and/or corners between the plurality of turn legs 36 of cooling circuit 32. That is, in the non-limiting example shown in FIG. 3, the transitions and/or corners formed between each of the plurality of turn legs 36 of cooling circuit 32 are substantially perpendicular, sharp and/or angular (e.g., 90 degrees). In the non-limiting example shown in FIG. 6, transitions and/or corners formed between each of the plurality of turn legs 36 of cooling circuit 32 are substantially curved, rounded and/or smooth. The rounded or curved transitions and/or corners formed between each of the plurality of turn legs 36 may allow for better flow through cooling circuit 32 at the plurality of turn legs 36 and/or may substantially prevent coolant 40 from becoming trapped within the plurality of turn legs 36. This may in turn help to improve heat transfer and/or cooling within multi-wall airfoil 6 of turbine blade 2, as discussed above.

Figure 7:
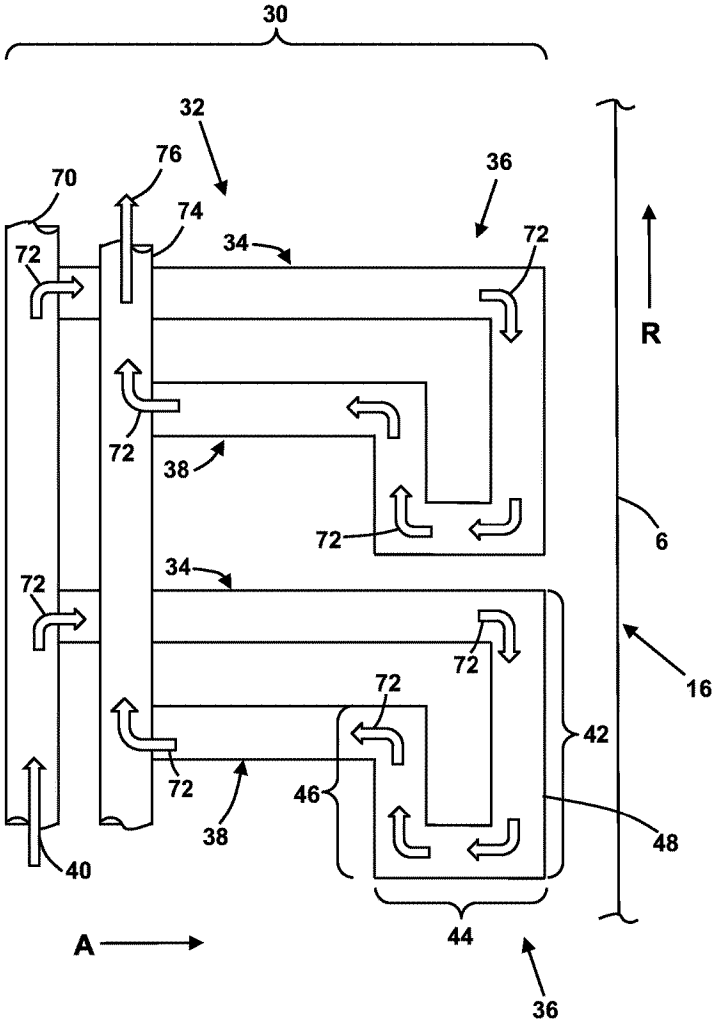
FIG. 7 is a side view of cooling circuits including a plurality of turn legs of a trailing edge cooling system according to another embodiment.

FIG. 7 depicts an additional non-limiting example of a trailing edge cooling system 30 including a cooling circuit 32 having a plurality of turn legs 36. With comparison to FIG. 3, the non-limiting example of cooling circuit 32 shown in FIG. 7 may include a distinct orientation for the plurality of turn legs 36. Specifically, the plurality of turn legs 36 of cooling circuits 32 shown in FIG. 7 may be substantially flipped and/or mirrored from the plurality of turn legs 36 depicted in FIG. 3. As shown in FIG. 7, and similar to FIG. 3, first turn leg 42 may be in direct fluid communication with outward leg 34, third turn leg 46 may be in direct fluid communication with return leg 38, and second turn leg 44 may be in direct fluid communication with and positioned between first turn leg 42 and third turn leg 46.

However, distinct from cooling circuits 32 depicted in FIG. 3, first turn leg 42 may be positioned directly adjacent trailing edge 16. Specifically, and as shown in FIG. 7, first turn leg 42 may be positioned directly adjacent to, and may extend radially adjacent and/or substantially parallel to trailing edge 16 of multi-wall 6. First turn leg 42 may extend radially downward from outward leg 34, adjacent trailing edge 16, and toward/beyond return leg 38. Additionally as shown in FIG. 7, first turn leg 42 may also include outer wall 48 positioned directly adjacent to and/or substantially parallel to trailing edge 16, as similarly described herein. Second turn leg 44 may extend substantially perpendicular to and/or axially away from first turn leg 42 and/or trailing edge 16 of multi-wall airfoil 6. Additionally, third turn leg 46 may extend radially upward, and/or substantially perpendicular to second turn leg 44, toward return leg 38. Additionally, third turn leg 46 may extend radially and substantially parallel to first turn leg 42 and/or trailing edge 16 of multi-wall airfoil 6.

In the non-limiting example shown in FIG. 7, portion 72 of the flow of coolant 40 may also follow a distinct flow path within cooling circuits 32 than that described herein with respect to FIG. 3. As shown in FIG. 7, portion 72 of the flow of coolant 40 may flow axially toward trailing edge 16 through outward leg 36. Subsequently, portion 72 of the flow of coolant 40 may flow into first turn leg 42 of the plurality of turn legs 36 of cooling circuit 32. Specifically, portion 72 of coolant 40 may flow into and may flow radially downward through first turn leg 42, along outer wall 48, and directly adjacent to and/or substantially parallel to trailing edge 16 of multi-wall airfoil 6. After flowing through first turn leg 42, portion 72 of coolant 40 may flow axially and/or perpendicularly away from trailing edge 16 through second turn leg 44. Next, portion 72 of coolant 40 may flow radially upward and substantially parallel to first turn leg 42 and/or trailing edge 16, as portion 72 of coolant 40 flows through third turn leg 46 of the plurality of turn legs 36 of cooling circuit 32. Finally, portion 72 of coolant 40 may flow axially away from trailing edge 16 through return leg 38, and may, for example, be provided to other portions of multi-airfoil 6 to provide film cooling, as discussed herein.

To provide additional cooling of the trailing edge of multi-wall airfoil/blade and/or to provide cooling film directly to the trailing edge, exhaust passages (not shown) may pass from any part of any of the cooling circuit(s) described herein through the trailing edge and out of the trailing edge and/or out of a side of the airfoil/blade adjacent to the trailing edge. Each exhaust passage(s) may be sized and/or positioned within the trailing edge to receive only a portion (e.g., less than half) of the coolant flowing in particular cooling circuit(s). Even with the inclusion of the exhaust passages(s), the majority (e.g., more than half) of the coolant may still flow through the cooling circuit(s), and specifically the return leg thereof, to subsequently be provided to distinct portions of multi-wall airfoil/blade for other purposes as described herein, e.g., film and/or impingement cooling.

Figure 8:
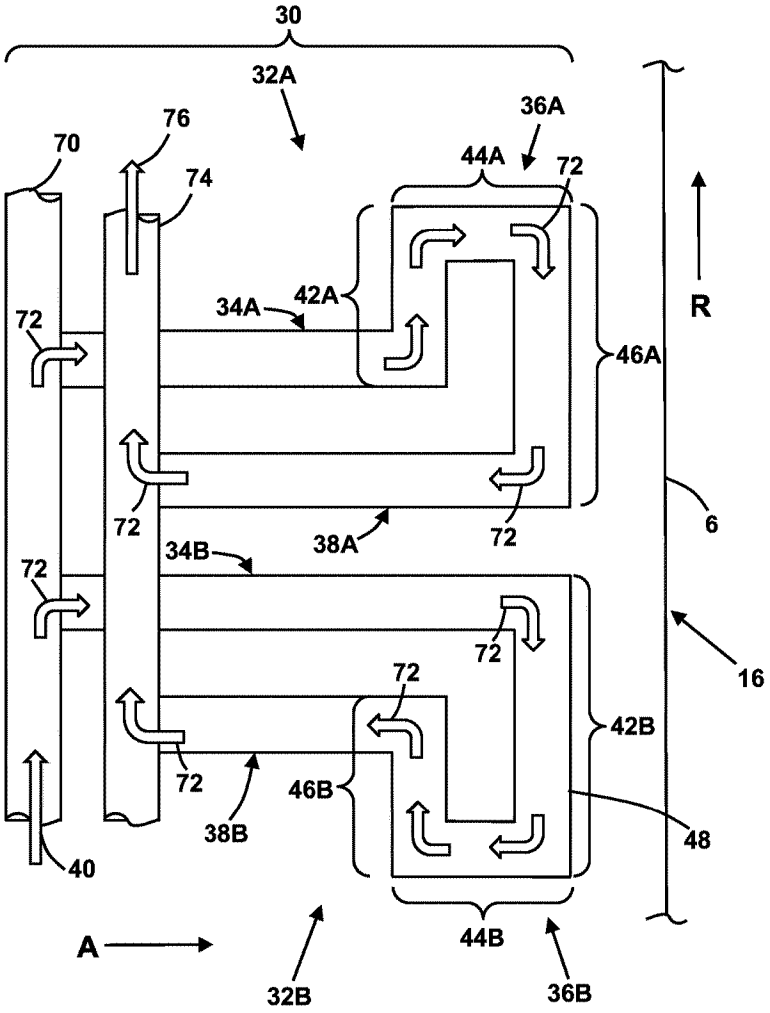
FIG. 8 is a side view of cooling circuits including a plurality of turn legs of a trailing edge cooling system according to further embodiments.
Figure 9:
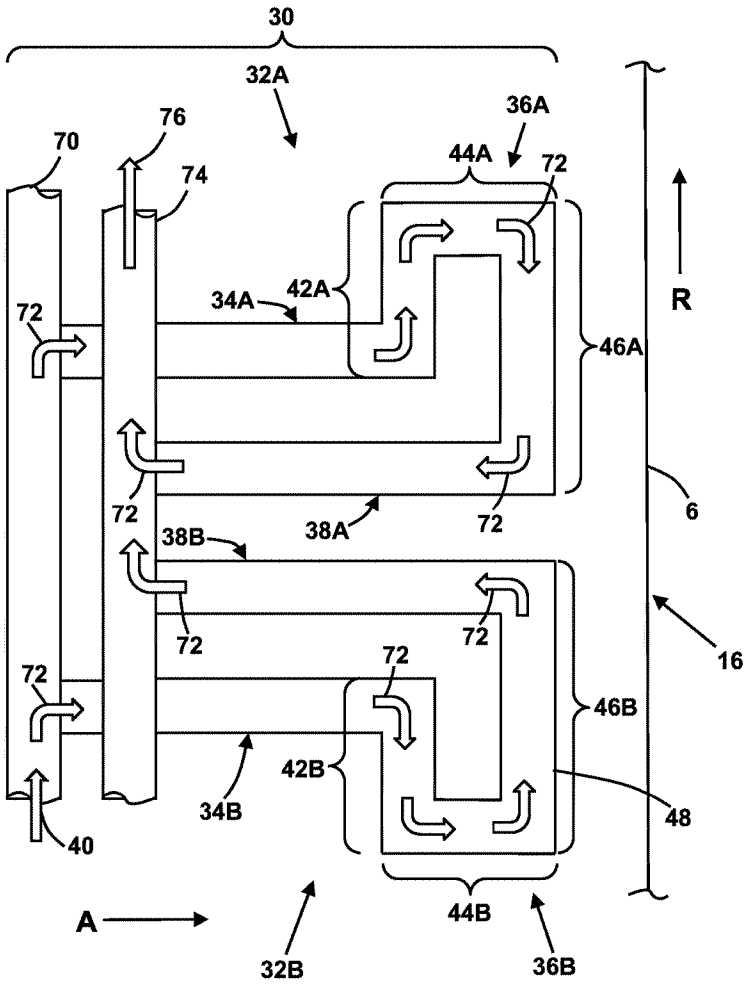
FIG. 9 is a side view of cooling circuits including a plurality of turn legs of a trailing edge cooling system according to additional embodiments.
Figure 10:
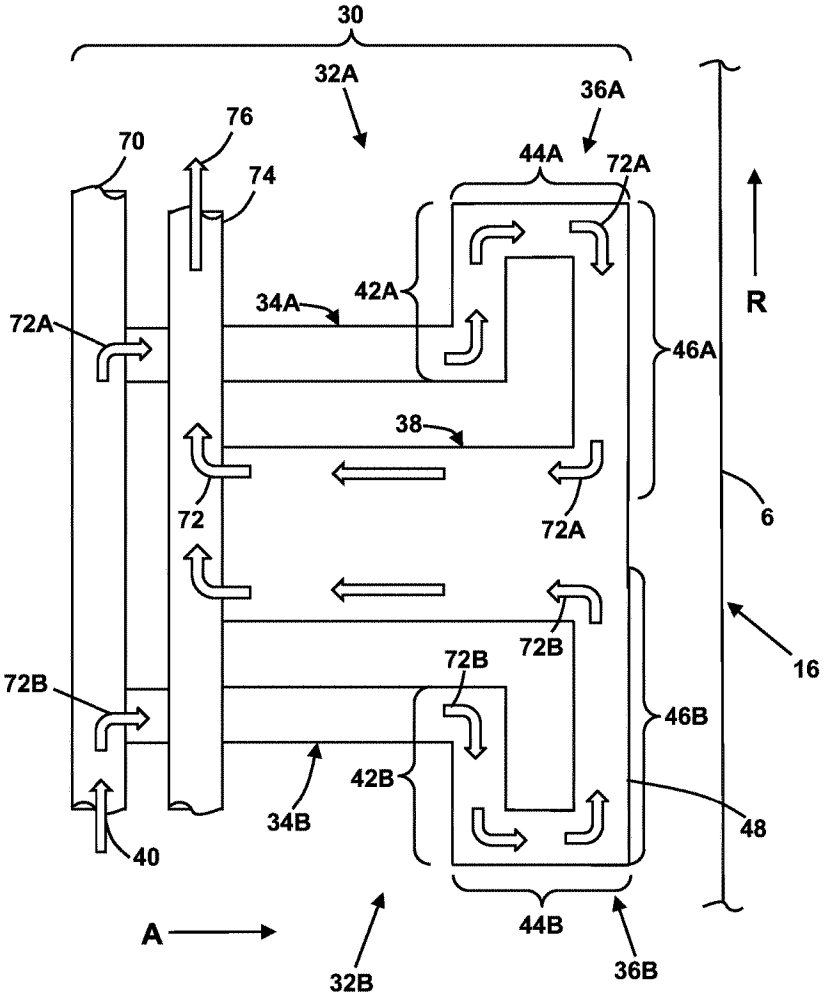
FIG. 10 is a side view of cooling circuits including a plurality of turn legs of a trailing edge cooling system according to further embodiments.

FIGS. 8-10 depict additional, non-limiting examples of cooling circuits 32A, 32B of trailing edge cooling system 30. As discussed below, portions of cooling circuits 32A, 32B shown in FIGS. 8-10 may be substantially similar to cooling circuits previously discussed. Additionally, and as discussed in detail below, other portions of cooling circuit 32A, 32B may be formed and/or function in a distinct manner. As a result, at least a portion of coolant 40 may flow through trailing edge cooling system 30 shown in FIGS. 8-10 in a unique or distinct path.

A shown in FIG. 8, first cooling circuit 32A may be substantially similar to cooling circuit 32 of trailing edge cooling system 30 shown and discussed herein with respect to FIG. 3. Specifically, first cooling circuit 32A and its various portions (e.g., outward leg 34A, plurality of turn legs 36A, return leg 38A) may be configured, formed, oriented and/or function in a substantially similar fashion as outward leg 34, the plurality of turn legs 36 and return leg 38 of cooling circuit 32 shown and discussed herein with respect to FIG. 3. Additionally, second cooling circuit 32B may be substantially similar to cooling circuit 32 of trailing edge cooling system 30 shown and discussed herein with respect to FIG. 7. Specifically, second cooling circuit 32B and its various portions (e.g., outward leg 34B, plurality of turn legs 36B, return leg 38B) may be configured, formed, oriented and/or function in a substantially similar fashion as outward leg 34, the plurality of turn legs 36 and return leg 38 of cooling circuit 32 shown and discussed herein with respect to FIG. 7.

A shown in FIG. 9, and similar to FIG. 8 first cooling circuit 32A and its various portions (e.g., outward leg 34A, plurality of turn legs 36A, return leg 38A) may be configured, formed, oriented and/or function in a substantially similar fashion as outward leg 34, the plurality of turn legs 36 and return leg 38 of cooling circuit 32 shown and discussed herein with respect to FIG. 3. However, distinct from FIGS. 7 and 8, second cooling circuit 32B may be formed and/or function in a distinct manner than the non-limiting examples discussed herein. Specifically, and as shown in FIG. 9, outward leg 34B of second cooling circuit 32B may be positioned and/or formed radially below or under return leg 38B. As a result, return leg 38A of first cooling circuit 32A may be positioned directly adjacent and/or radially above return leg 38B of second cooling circuit 32A.

As discussed herein, the plurality of turn legs 36B of second cooling circuit 32B may be coupled and/or in direct fluid communication with similar legs of second cooling circuit 32B. For example, first turn leg 42B may be in direct fluid communication with outward leg 44B and second turn leg 44B, respectively, and third turn leg 46B may be in direct fluid communication with return leg 38B and second turn leg 44B, respectively. However, because of the distinct formation and/or configuration of second cooling circuit 32B, the flow path of portion 72 of coolant 40 flowing through second cooling circuit 32B may be unique. As shown in FIG. 9, and similarly discussed herein, portion 72 of coolant 40 may flow through outward leg 34B in an axial direction toward trailing edge 16 of multi-wall airfoil 6. Once portion 72 of coolant 40 reaches the plurality of turn legs 36B of second cooling circuit 32, the flow path of portion 72 may be unique before reaching return leg 38B. Specifically, portion 72 of coolant 40 may flow radially downward through first turn leg 42B, and then axially toward trailing edge 16 of multi-wall airfoil 6 through second turn leg 44B. From second turn leg 44B, portion 72 of coolant 40 may flow radially upward (e.g., toward tip area 52) through third turn leg 46B, and into return leg 38B. As shown in FIG. 9, and similarly discussed herein, portion 72 of coolant 40 flowing radially upward through third turn leg 46B may also flow directly adjacent to and/or substantially parallel with trailing edge 16 of multi-wall airfoil 6. Finally, portion 72 of coolant 40 may flow axially through return leg 38B and/or axially away from trailing edge 16 of multi-wall airfoil 6, and into collection passage 74.

Turning to the non-limiting example depicted in FIG. 10, portions of cooling circuits 32A, 32B may be may be substantially similar to cooling circuits 32A, 32B discussed herein with respect to FIG. 9. Specifically, outward legs 34A, 34B and the plurality of turn legs 36A, 36B of cooling circuits 32A, 32B shown in FIG. 10 may be configured, formed and/or function in a substantially similar fashion as outward legs 34A, 34B and the plurality of turn legs 36A, 36B shown and discussed herein with respect to FIG. 9. Additionally, first outward leg 34A may be substantially similar to second outward legs 34B of cooling circuits 32. Additionally, the first plurality of turn legs 36A may be substantially similar to the second plurality of turn legs 36B. However, second outward leg 34B and the second plurality of turn legs 36B may be oriented, formed and/or positioned as a "mirror image" of first outward leg 34A and first plurality of turn legs 36A, respectively. As a result, the flow of portion 72 of coolant 40 through the second plurality of turn legs 36B may be distinct and/or opposite than the flow of coolant 40 through the first plurality of turn legs 36A. As shown in FIG. 10, portion 72B of coolant 40 may flow through second outward leg 34B in a substantially similar manner (e.g., axially toward trailing edge 16) as portion 72A of coolant 40 flowing through first outward leg 34A. However, once portion 72B of coolant 40 reaches the second plurality of turn legs 36B, the flow path may vary and/or be the opposite of the flow of portion 72A. Portion 72B of coolant 40 may flow radially downward toward shank 4 of turbine blade 2 (see, e.g., FIG. 1) when flowing through first turn leg 42B of the second plurality of turn legs 36B. Portion 72B of coolant 40 may flow axially toward trailing edge 16 of multi-wall airfoil 6 when flowing through second turn leg 44B of the second plurality of turn legs 36B, and subsequently may flow radially upward toward a single return leg 38 of cooling circuit 32, as discussed herein.

As shown in FIG. 10, and distinct from the non-limiting examples previously discussed, two distinct sets of outward legs 34A, 34B and the plurality of turn legs 36A, 36B may share a single return leg 38. Specifically, the first plurality of turn legs 36A and the second plurality of turn legs 36B may be in direct fluid communication and/or may be fluidly coupled to single return leg 38 of cooling circuit 32. As previously discussed herein, single return leg 38 may extend substantially perpendicular to trailing edge 16 of multi-wall turbine airfoil 6. Additionally, and as shown in FIG. 10, single return leg 38 may extend, be positioned between and/or may be substantially parallel to first outward leg 34A and second outward leg 34B of cooling circuit 32. As discussed herein, the distinct portions 72A, 72B of coolant 40 that flows through the first plurality of turn legs 36A and the second plurality of turn legs 36B, respectively, may converge, combine and/or flow into and through single return leg 38 of cooling circuit 32.

Figure 11:
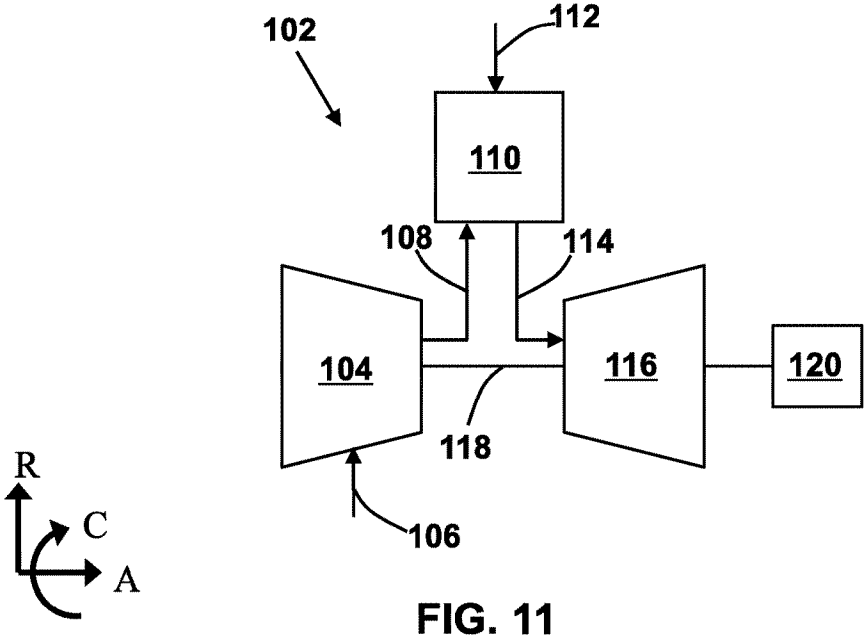
FIG. 11 is a schematic diagram of a gas turbine system according to various embodiments.

FIG. 11 shows a schematic view of gas turbomachine 102 as may be used herein. Gas turbomachine 102 may include a compressor 104. Compressor 104 compresses an incoming flow of air 106. Compressor 104 delivers a flow of compressed air 108 to a combustor 110. Combustor 110 mixes the flow of compressed air 108 with a pressurized flow of fuel 112 and ignites the mixture to create a flow of combustion gases 114. Although only a single combustor 110 is shown, gas turbine system 102 may include any number of combustors 110. The flow of combustion gases 114 is in turn delivered to a turbine 116, which typically includes a plurality of turbine blades 2 (FIG. 1). The flow of combustion gases 114 drives turbine 116 to produce mechanical work. The mechanical work produced in turbine 116 drives compressor 104 via a shaft 118, and may be used to drive an external load 120, such as an electrical generator and/or the like.

In various embodiments, components described as being "fluidly coupled" to or "in fluid communication" with one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., fastening, ultrasonic welding, bonding).

When an element or layer is referred to as being "on", "engaged to", "connected to" or "coupled to" another element, it may be directly on, engaged, connected or coupled to the other element, or intervening elements may be present. In contrast, when an element is referred to as being "directly on," "directly engaged to", "directly connected to" or "directly coupled to" another element, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Additionally, in various embodiments, components described as being "substantially parallel" or "substantially perpendicular" with another component are understood to be exactly parallel/perpendicular to each other, or slightly angled from each other, within an acceptable range. In the latter instance, the acceptable range may be determined and/or defined as an angle that does not reduce or diminish the operation and/or function of the components described as being "substantially parallel" or "substantially perpendicular." In non-limiting examples, components discussed herein as being "substantially parallel" or "substantially perpendicular," may have no angular degree of variation (e.g., +/−0°), or alternatively, may have a small or minimal angular degree of variation (e.g., +/−15°). It is understood that the acceptable angular degree of variation discussed herein (e.g., +/−15°) is merely illustrative, and is not limiting.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A trailing edge cooling system for a turbine blade, the trailing edge cooling system comprising:
- a coolant feed extending radially within the turbine blade;
- a collection passage extending radially within the turbine blade, adjacent the coolant feed; and
- a cooling circuit in fluid communication with the coolant feed and the collection passage, the cooling circuit including:
  - an outward leg extending axially toward a trailing edge of the turbine blade, the outward leg in direct fluid communication with the coolant feed;
  - a return leg positioned adjacent the outward leg and extending axially from the trailing edge of the turbine blade, the return leg in direct fluid communication with the collection passage; and
  - a plurality of turn legs fluidly coupling the outward leg and the return leg, the plurality of turn legs including:
    - a first turn leg in direct fluid communication with and extending radially from the outward leg;
    - a second turn leg in direct fluid communication with the first turn leg, the second turn leg extending axially from the first turn leg toward the trailing edge of the turbine blade; and
    - a third turn leg extending radially through the turbine blade, directly adjacent the trailing edge, the third turn leg in direct fluid communication with the second turn leg and the return leg.

2. The trailing edge cooling system of claim 1, wherein the third turn leg of the plurality of turn legs is substantially parallel to the trailing edge of the turbine blade.

3. The trailing edge cooling system of claim 1, wherein the third turn leg extends substantially parallel to the first turn leg of the plurality of turn legs.

4. The trailing edge cooling system of claim 1, wherein at least a portion of the third turn leg of the plurality of turn legs extends radially above the outward leg.

5. The trailing edge cooling system of claim 1, wherein at least a portion of the third turn leg of the plurality of turn legs extends radially below the second turn leg.

6. The trailing edge cooling system of claim 1, wherein the third turn leg of the plurality of turn legs includes an outer wall positioned at least one of:
- directly adjacent to the trailing edge of the turbine blade, and
- substantially parallel to the trailing edge of the turbine blade.

7. A turbine blade comprising:
- a trailing edge cooling system disposed within the turbine blade, the trailing edge cooling system including:
  - a coolant feed extending radially within the turbine blade;
  - a collection passage extending radially within the turbine blade, adjacent the coolant feed; and
  - a plurality of cooling circuits extending at least partially along a radial length of a trailing edge of the turbine blade, each of the plurality of cooling circuits in direct fluid communication with the coolant feed and the collection passage and each of the plurality of cooling circuits including:
    - an outward leg extending axially toward the trailing edge of the turbine blade, the outward leg in direct fluid communication with the coolant feed;
    - a return leg positioned adjacent the outward leg and extending axially from the trailing edge of the turbine blade, the return leg in direct fluid communication with the collection passage; and
    - a plurality of turn legs fluidly coupling the outward leg and the return leg, the plurality of turn legs including:
      - a turn leg positioned directly adjacent the trailing edge of the turbine blade; and
      - a distinct turn leg positioned axially adjacent the turn leg, opposite the trailing edge of the turbine blade, the distinct turn leg oriented non-parallel to at least one of the outward leg and the return leg.

8. The turbine blade of claim 7, wherein the turn leg of each of the plurality of cooling circuits is substantially parallel to the trailing edge of the turbine blade.

9. The turbine blade of claim 7, wherein the turn leg of each of the plurality of cooling circuits extends substantially parallel to the distinct turn leg of the cooling circuit.

10. The turbine blade of claim 7, wherein the turn leg of each of the plurality of cooling circuits includes an outer wall positioned at least one of:
- directly adjacent to the trailing edge of the turbine blade, and
- substantially parallel to the trailing edge of the turbine blade.

11. The turbine blade of claim 7, wherein the turn leg of each of the plurality of cooling circuits is in direct fluid communication with one of:
- the outward leg, or
- the return leg.

12. A trailing edge cooling system for a turbine blade, the trailing edge cooling system comprising:

a coolant feed extending radially within the turbine blade;

a collection passage extending radially within the turbine blade, adjacent the coolant feed; and a cooling circuit in fluid communication with the coolant feed and the collection passage, the cooling circuit including:

an outward leg extending axially toward a trailing edge of the turbine blade, the outward leg in direct fluid communication with the coolant feed;

a return leg positioned adjacent the outward leg and extending axially from the trailing edge of the turbine blade, the return leg in direct fluid communication with the collection passage; and a plurality of turn legs fluidly coupling the outward leg and the return leg, the plurality of turn legs including:

a first turn leg in direct fluid communication with and extending radially from the outward leg, the first turn leg extending directly adjacent the trailing edge;

a second turn leg in direct fluid communication with the first turn leg, the second turn leg extending axially from the first turn leg and away from the trailing edge of the turbine blade; and a third turn leg extending radially from the second turn leg, the third turn leg in direct fluid communication with the second turn leg and the return leg.

13. The trailing edge cooling system of claim 12, wherein the first turn leg of the plurality of turn legs is substantially parallel to the trailing edge of the turbine blade.

14. The trailing edge cooling system of claim 12, wherein the third turn leg extends substantially parallel to the first turn leg of the plurality of turn legs.

15. The trailing edge cooling system of claim 12, wherein at least a portion of the first turn leg of the plurality of turn legs extends radially below the return leg.

16. The trailing edge cooling system of claim 12, wherein at least a portion of the first turn leg of the plurality of turn legs extends radially above the second turn leg.

17. The trailing edge cooling system of claim 12, wherein the first turn leg of the plurality of turn legs includes an outer wall positioned at least one of:

directly adjacent to the trailing edge of the turbine blade, and substantially parallel to the trailing edge of the turbine blade.

* * * * *